US005950256A

United States Patent [19]

Slater

[11] Patent Number: 5,950,256

[45] Date of Patent: Sep. 14, 1999

[54] FOLDABLE HOT TUB SEAT

[75] Inventor: Thomas A. Slater, Bonita Springs, Fla.

[73] Assignee: The Snorkel Stove Company, Yakima, Wash.

[21] Appl. No.: 09/047,987

[22] Filed: Mar. 25, 1998

[51] Int. Cl.[6] ..... A47K 3/12

[52] U.S. Cl. ..... 4/579; 4/559; 297/14

[58] Field of Search ..... 4/579, 496, 541.1, 4/559, 571.1, 573.1, 574.1, 575.1, 578.1, 604, 611; 297/14, 440.24, 451.13

[56] References Cited

U.S. PATENT DOCUMENTS

| | | | |
|---|---|---|---|
| 1,059,505 | 4/1913 | Tuttle | 4/559 |
| 2,902,699 | 9/1959 | Miller | 4/559 |
| 3,405,972 | 10/1968 | Morris | 297/14 |
| 4,837,869 | 6/1989 | Simmon | 4/559 |
| 4,893,363 | 1/1990 | Huff | 4/496 |
| 5,185,892 | 2/1993 | Mitchell | 4/578.1 |
| 5,307,527 | 5/1994 | Schober | 4/496 |
| 5,367,724 | 11/1994 | Coccagna | 4/571.1 |
| 5,427,435 | 6/1995 | Yoder, Jr. | 297/440.24 |
| 5,678,890 | 10/1997 | Tenbroeck | 297/451.13 |

*Primary Examiner*—Charles R. Eloshway
*Attorney, Agent, or Firm*—Seed & Berry LLP

[57] ABSTRACT

A submersible, foldable seat for use in a hot tub. The seat is folded down to be used as a seat and folded up to provide an increased unobstructed area for use of the hot tub for other activities such as exercise. The foldable seat uses pivoting attachment members which allow flush connection to the curved hot tub wall. Frame members of the seat use connectors with transverse apertures to rotatably receive tubular portions of the seat frame to allow folding of the seat.

32 Claims, 2 Drawing Sheets

FOLDABLE HOT TUB SEAT

TECHNICAL FIELD

The present invention is directed generally to hot tub seats, and more particularly, to foldable hot tub seats.

BACKGROUND OF THE INVENTION

Since recorded time mankind has used bodies of water whether naturally formed or man-made for recreational and therapeutic uses. More recently man-made "bodies of water" have included hot tubs generally made out of wood staves and generally circular in shape, fiberglass and acrylic spas of various shapes, and in-ground and above-ground pools. For purposes of this application "hot tub", includes fiberglass and acrylic spas, hot tubs traditionally made from wood staves, and other spas, tubs and pools for holding water and people.

As part of the therapeutic use of these bodies of water, people have adapted them for various forms of exercise which would include running in place and other aerobic exercises. The increased drag provided by the water serves to make these forms of exercise quite effective while the buoyancy of the water reduces the amount of impact, making aquatic exercise safer than some other forms of exercise.

Acrylic and fiberglass spas generally have molded seats which are immovable. Thus, these forms of hot tubs are not readily conducive to the exercise mentioned since the immovable seats take up a large area of the hot tub. Other hot tubs have no seats and allow for the exercise mentioned. However, the lack of seats limits the use of the hot tub to exercise and does not permit the user to assume a seated position when relaxing. Therefore, it can be appreciated that there is a need for hot tub seating which is movable to provide additional area when aquatic exercise is desired in the hot tub and yet can be readily returned into position for seating when more relaxing use of the hot tub is desired. The present invention provides this and other advantages, as will become apparent from the following figures and accompanying detailed description.

SUMMARY OF THE INVENTION

The present invention is a foldable seat for use in a hot tub, and a foldable seat and hot tub system. The seat has a front frame and a back frame attachable to a sidewall of the hot tub. The seat also has a first cross-member with first and second ends. The first end of the first cross-member being rotatably connected to the front frame and the second end of the first cross-member being rotatably connected to the back frame. The seat also has a second cross-member with first and second ends, and spaced away from the first cross-member. The first end of the second cross-member being rotatably connected to the front frame and the second end of the second cross-member being rotatably connected to the back frame.

In one embodiment, the front and back frames and first and second cross-members include tubular portions. In another embodiment, the front and back frame members and the first and second cross-members are manufactured of polyvinyl chloride (PVC) material. The first ends of the first and second cross-members can include a coupler portion with a transverse aperture sized to rotatably receive a corresponding tubular portion of the front frame. The second ends of the first and second cross-members can include a coupler portion with a transverse aperture size to rotatably receive a corresponding tubular portion of the back frame.

The coupler portion in one embodiment is a "T" shaped coupler having a first leg attached to an end portion of the cross-member and a transverse leg with an aperture formed to rotatably receive the corresponding tubular portion of one of the front or back frames. In one embodiment, a seat portion is connected to an upper side of a cross-member which is positioned toward an upper side of the front and back frames.

Each of the front and back frame can include an upper frame member and a lower frame member spaced below the upper frame member, and left and right side frame members extending between the upper and lower frame members and attached thereto. The back frame can include a rearward projecting attachment member having a forward end attached to one of the side frame members of the back frame and a rearward end adapted for secure attachment to the sidewall of the hot tub. Here the left and right side frame members to which the forward end of the attachment member is attached can have a tubular portion and the forward end of the attachment member can have a coupler portion with a transverse aperture sized to rotatably receive the tubular portion. The hot tub can have a curved sidewall portion wherein a portion of the attachment member is attached to the curved sidewall.

Other features and advantages of the invention will become apparent from the following detailed description, taken in conjunction with the accompanying drawings.

DETAILED DESCRIPTION OF THE INVENTION

Figure 1:
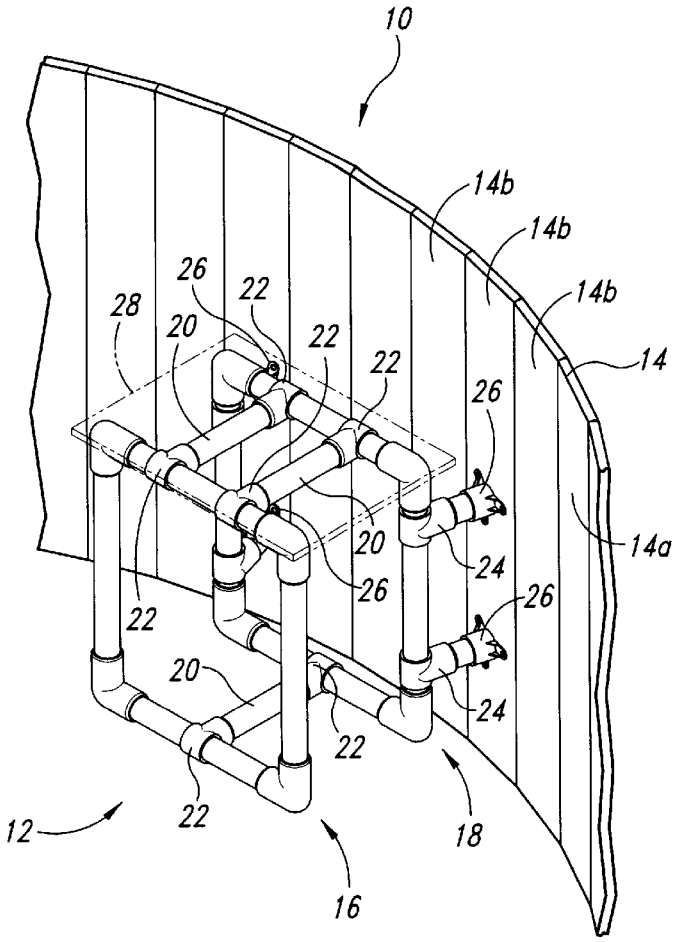
FIG. 1 is an isometric partially sectional view of a foldable seat and hot tub system of the present invention.

As shown in the drawings for purposes of illustration, the present invention is embodied in a foldable seat and hot tub system 10. In the preferred embodiment, the seat has a tubular construction using polyvinyl chloride (PVC) tubes and fittings. The foldable seat and hot tub system 10 has a foldable seat 12 positionable in a hot tub 14. The foldable seat 12 has a front frame 16, a back frame 18, a plurality of cross-members 20 pivotally attached to the front and rear frames by slip fit rotatable "T" connectors 22, and attachment members 24 for attaching the foldable seat to a curved sidewall 14*a* of the hot tub. The attachment members 24 have a forward end for attachment to the back frame 18 and a rearward end which includes a flange portion 26 for secure attachment to the curved sidewall 14*a* of the hot tub 14. The flange portion has holes so screws can be used for attachment to the sidewall of the hot tub 14. In the preferred embodiment, the foldable seat 12 includes a seat portion 28 shown in phantom line.

As depicted in FIG. 1, the front frame 16 is pivotally connected to the back frame 18 by the cross-members 20 that are spaced away from one another. The cross-members 20 are attached to the front frame 16 and back frame 18 by the rotatable "T" connectors 22. The seat portion 28 is rigidly connected to the cross-members 20 which connect the top portions of the front frame 16 and the back frame 18.

As further depicted by FIG. 1, the rotatable connectors 22 are "T" shaped couplers and comprise coupler portions at both ends of the cross-members 20. Each "T" shaped rotatable connector 22 has a first leg securely attached to an end portion of a tubular portion of a corresponding cross-member 20 and a transverse leg with an aperture formed therein sized to rotatably receive a tubular portion of the corresponding one of the front and back frames 16 or 18.

A pair of first cross-members 20 are positioned toward an upper side of the front and back frames 16 and 18, and the seat portion 28 is connected to an upper side of the first cross-members. The front and back frames 16 and 18 each include an upper frame member and a lower frame member spaced below the upper frame member, and left and right side frame members extending between the upper and lower frame members and attached thereto. The frame members are attached together using slip fit tubular elbow connectors and secured together using either suitable glue or fasteners such as screws which are screwed into the elbow and frame member. The elbow connectors, slip "T" couplers used for the rotatable connectors 22, as well as other attachment fittings are made of PVC so as to be durable and submersible in water for prolonged periods. The left and right side frame members can be readily cut to any desirable length when the seat 12 is assembled at the location of the hot tub 14 to position the seat for the proper height and for any desired tilt or slant.

A forward end of each of the first cross-members 20 is rotatably connected to the upper frame member of the front frame 16 and a rearward end of the first cross-members is rotatably connected to the upper frame member of the back frame 18. Similarly, a forward end of a second cross-member 20 is rotatably connected to the lower frame member of the front frame 16, and a rearward end of the second cross-member is rotatably connected to the lower frame member of the back frame 18.

The forward end of each attachment member 24 is attached to the left or right side frame members of the back frame 18. These left and right side frame members have a tubular portion and the forward end of the attachment member 24 has a "T" shaped coupler with a first leg securely attached to a forward end of the attachment member and a transverse leg with an aperture therein sized to rotatably receive the tubular portion of the side frame member.

Figure 2:
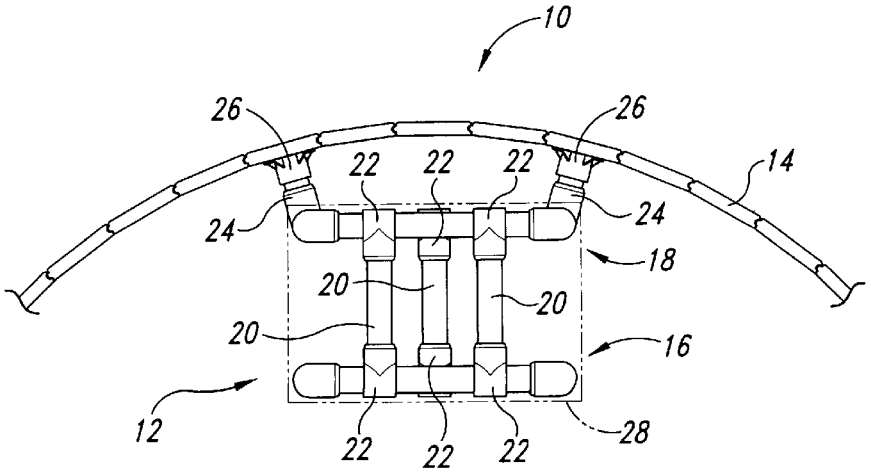
FIG. 2 is a top plan view of the foldable seat and hot tub system of FIG. 1.

As depicted in FIG. 2, the foldable seat 12 is sized and positioned with the attachment members 24 rotated laterally outward into position such that the attachment member is substantially perpendicular to a tangent line of the curved sidewall 14*a* of the hot tub 14. A mounting end of the flange portion 26 of the attachment member 24 is thereby positioned substantially flush against the curved sidewall 14*a*. Also as depicted in FIG. 2, the upper and lower frame members of the back frame 18 have a sufficient length to allow the attachment members 24 to be rotated in spaced apart positions which locates their flange portions 26 for attachment to the sidewall 14*a* of the hot tub 14 at positions away from any seals, grooves, cracks, or other interfaces caused by the construction of the sidewall of the hot tub. The illustrated hot tub 14 of FIGS. 1 and 2 shows vertical staves 14*b* with the flange portions 26 of the attachment members 24 each attached at the center of a corresponding one of the staves clear of the joints between the staves.

Figure 3A:
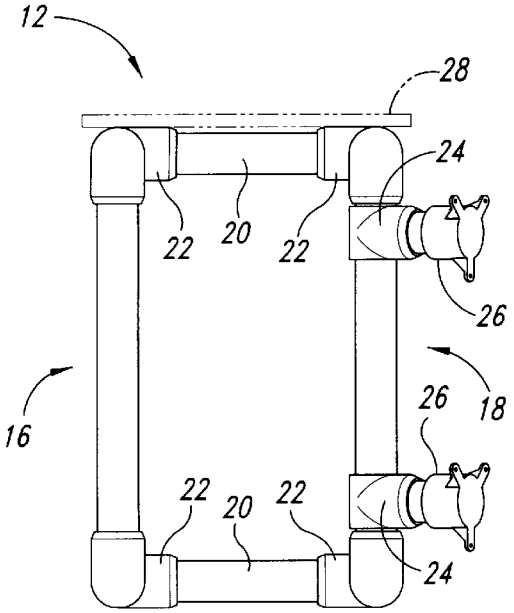
FIG. 3A is a side elevational view of the foldable seat of FIG. 1 shown in a fully down position.
Figure 3B:
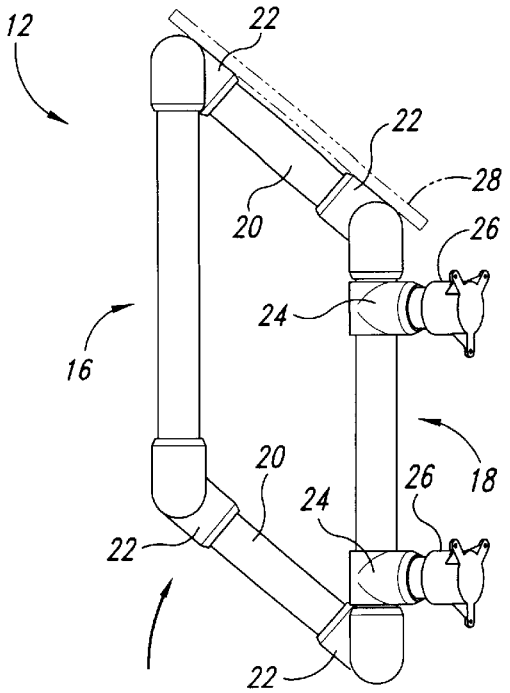
FIG. 3B is a side elevational view of the foldable seat of FIG. 1 shown in a partially folded up position.
Figure 3C:
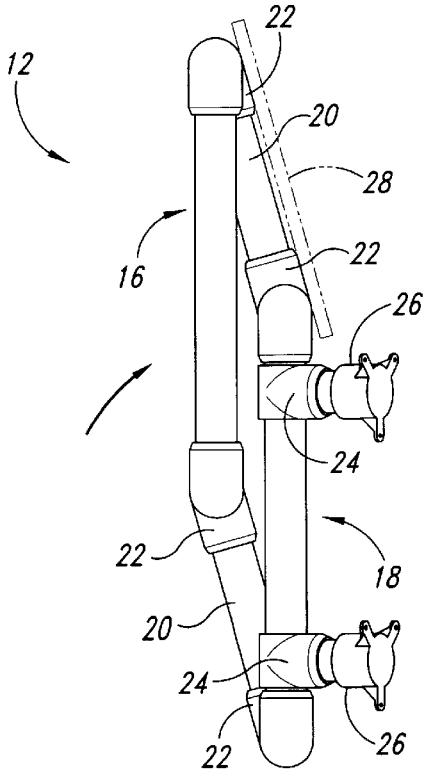
FIG. 3C is a side elevational view of the foldable seat of FIG. 1 shown in a fully folded up position.

FIGS. 3A, 3B, and 3C are side elevational views of the foldable seat 12 and depict different positions of the foldable seat. In FIG. 3A, the foldable seat 12 is shown folded fully down to allow a user to sit on the seat portion 28. In FIG. 3C the foldable seat is shown fully folded up so as to be in close proximity to the sidewall 14*a* of the hot tub 14 such that the user can use the remaining space in the hot tub for other activities such as exercise. FIG. 3B shows the foldable seat in a position midway between the positions shown in FIGS. 3A and 3C through which the foldable seat would be folded when being folded up or down. The rotatable "T" connectors 22 which connect the cross-members 20 to the front frame 16 and back frame 18 give the foldable seat 12 its ability to fold into a compact state. As shown in FIGS. 3A, 3B, and 3C, the rotatable "T" connectors 22 connecting the forward ends of the cross-members 20 to the front frame 16 rotate around a respective longitudinal axis of the upper frame member or a longitudinal axis of the lower frame member of the front frame 16, and the rotatable "T" connectors 22 connecting the rearward ends of the cross-members 20 to the back frame 18 rotate around a respective longitudinal axis of the upper frame member or a longitudinal axis of the lower frame member of the back frame 18.

Figure 4:
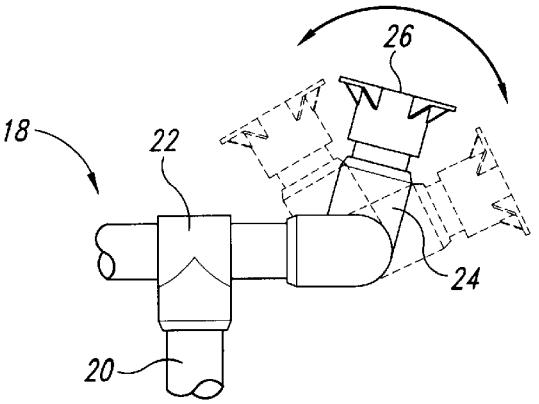
FIG. 4 is an enlarged, fragmentary top plan view of the foldable seat of FIG. 1 illustrating a pivotable attachment member in three positions.

The attachment member 24 depicted in FIG. 4 is shown rotated into three different angular positions, but can be rotated to any desired position needed to align the flange portion 26 substantially flush against the curved sidewall 14*a* of the hot tub 14. The attachment members 24 each rotate about a longitudinal axis of a respective one of the left and right side frame members of the back frame 18.

Although the preferred embodiment uses tubular construction of PVC material, the foldable seat and hot tub system 10 could be constructed from other materials which are appropriate for the hot tub environment. PVC will not corrode when submerged or out of the water, is heat resistant, and resists sun damage.

The front frame 16 and back frame 18 are shown in the drawings as four sided, with a rectangular shape, but frames of the foldable seat 12 are not limited to this shape. Rather, other shapes could also be used in the foldable seat construction. The foldable seat 12 is also shown with one cross-member 20 used to connect the lower frame member of the front frame 16 to the lower frame member of the back frame 18, and two cross-members 20 used to connect the upper frame member of the front frame 16 to the upper frame member of the back frame 18. However, the foldable seat 12 is not limited to use of these numbers of cross-members 20. Rather, the foldable seat 12 could be constructed with fewer or more cross-members 20. Also, the cross-members 20 could be placed so that they connect to the left and right side frame members of the front frame 16 and back frame 18, and allow the front frame to swing laterally to a folded position rather than upward. The connection of the cross-members 20 is not limited to connection solely to the upper and lower frame members of the front and back frames 16 and 18. The foldable seat 12 is shown in the drawings with four attachment members 24 used to attach the foldable seat to the sidewall 14*a* of the hot tub 14. Other numbers of attachment members 24 could be used.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A submersible, foldable seat for use in a hot tub having a sidewall for confining water therein, the seat comprising:

a front frame;

a back frame attachable to the sidewall of the hot tub;

a first cross-member with first and second ends, said first end of said first cross-member being rotatably connected to said front frame and said second end of said first cross-member being rotatably connected to said back frame; and a second cross-member with first and second ends, said second cross-member being spaced away from said first cross-member, said first end of said second cross-member being rotatably connected to said front frame and said second end of said second cross-member being rotatably connected to said back frame, said seat being foldable between use and non-use positions wherein in said use position, said seat is submerged and positioned inside the hot tub completely below the level of the top of the side wall to accommodate a user thereon.

2. The foldable seat of claim 1 wherein said front and back frames and said first and second cross-members include tubular portions.

3. The foldable seat of claim 2 wherein said first ends of said first and second cross-members each have a coupler portion with a transverse aperture sized to rotatably receive a corresponding tubular portion of said front frame therein, and said second ends of said first and second cross-members each have a coupler portion with a transverse aperture sized to rotatably receive a corresponding tubular portion of said back frame therein.

4. The foldable seat of claim 3 wherein each of said coupler portions of said first and second ends of said first and second cross-members is a "T" shaped coupler, each of said "T" shaped couplers having a first leg attached to an end portion of said tubular portion of the corresponding one of said first and second cross-members and a transverse second leg with said aperture formed therein to rotatably receive said tubular portion of the corresponding one of said front and back frames therein.

5. The foldable seat of claim 1 wherein said front and back frame members and said first and second cross-members are manufactured of polyvinyl chloride (PVC) material.

6. The foldable seat of claim 1 wherein said first cross-member is positioned toward an upper side of said front and back frames, and the foldable seat further includes a seat portion connected to an upper side of said first cross-member.

7. The foldable seat of claim 1 wherein each of said front and back frames includes an upper frame member and a lower frame member spaced below said upper frame member, and left and right side frame members extending between said upper and lower frame members and attached thereto.

8. The foldable scat of claim 7 wherein said first end of said first cross-member is rotatably connected to said upper frame member of said front frame, said second end of said first cross-member is rotatably connected to said upper frame member of said back frame, said first end of said second cross-member is rotatably connected to said lower frame member of said front frame, and said second end of said second cross-member is rotatably connected to said lower frame member of said back frame.

9. The foldable seat of claim 7 wherein said back frame includes a rearward projecting attachment member, said attachment member having a forward end attached to one of said left and right side frame members of said back frame and a rearward end adapted for secure attachment to the sidewall of the hot tub.

10. The foldable seat of claim 9 wherein the one of said left and right side frame members to which said forward end of said attachment member is attached has a tubular portion, and said forward end of said attachment member has a coupler portion with a transverse aperture sized to rotatably receive said tubular portion.

11. The foldable seat of claim 7 wherein said back frame includes a rearward projecting, left side attachment member having a forward end rotatably connected to said left side frame member of said back frame and a rearward end adapted for secure attachment to the sidewall of the hot tub, and a rearward projecting, right side attachment member having a forward end rotatably connected to said right side frame member of said back frame and a rearward end adapted for secure attachment to the sidewall of the hot tub.

12. The foldable seat of claim 11 for use with the hot tub having a set of staves, the staves being configured with joints between the staves, the joints being oriented vertically, wherein said upper and lower frame members of said back frame have lengths, said lengths being such that said left and right side attachment members are spaced apart from one another so that said rearward ends of said left and right side attachment members are each positionable at a center portion of a corresponding one of the staves.

13. The foldable seat of claim 12 wherein said rearward end of said left and right attachment members accommodates screws to secure said left and right attachment members to the staves at locations away from the joints of the staves.

14. The foldable seat of claim 7 wherein at least one of said front and back frames supports a seat, and said left and right side frame members have lengths, said lengths being adjustable to accommodate desired heights and inclinations of said seat.

15. The foldable seat of claim 14 wherein said lengths of said left and right side frame members are adjustable by removal of a length portion of said left and right side frame members.

16. The foldable seat of claim 1 wherein said front and back frames each include four frame members with a rectangular arrangement.

17. The foldable seat of claim 1 wherein said back frame includes a rearward projecting attachment portion having an end securely attachable to the sidewall of the hot tub.

18. A submersible, foldable seat and hot tub system, the system comprising:

a hot tub with a sidewall for confining water therein; and at least one foldable seat positioned in said hot tub, having:

a front frame;

a back frame attached to said sidewall of said hot tub;

a first cross-member with first and second ends, said first end of said first cross-member being rotatably connected to said front frame and said second end of said first cross-member being rotatably connected to said back frame; and a second cross-member with first and second ends, said second cross-member being spaced away from said first cross-member, said first end of said second cross-member being rotatably connected to said front frame and said second end of said second cross-member being rotatably connected to said back frame, said seat being foldable between use and non-use positions wherein in said use position, said seat is submerged and positioned inside the hot tub completely below the level of the top of the side wall to accommodate a user thereon.

19. The foldable seat and hot tub system of claim 18 wherein said front and back frames and said first and second cross-members include tubular portions.

20. The foldable seat and hot tub system of claim 19 wherein said first ends of said first and second cross-members each have a coupler portion with a transverse aperture sized to rotatably receive a corresponding tubular portion of said front frame therein, and said second ends of said first and second cross-members each have a coupler portion with a transverse aperture sized to rotatably receive a corresponding tubular portion of said back frame therein.

21. The foldable seat and hot tub system of claim 20 wherein each of said coupler portions of said first and second ends of said first and second cross-members is a "T" shaped coupler, each of said "T" shaped couplers having a first leg attached to an end portion of said tubular portion of the corresponding one of said first and second cross-members and a transverse second leg with said aperture formed therein to rotatably receive said tubular portion of the corresponding one of said front and back frames therein.

22. The foldable seat and hot tub system of claim 18 wherein said front and back frame members and said first and second cross-members are manufactured of polyvinyl chloride (PVC) material.

23. The foldable seat and hot tub system of claim 18 wherein said first cross-member is positioned toward an upper side of said front and back frames, and the foldable seat further includes a seat portion connected to an upper side of said first cross-member.

24. The foldable seat and hot tub system of claim 18 wherein each of said front and back frames includes an upper frame member and a lower frame member spaced below said upper frame member, and left and right side frame members extending between said upper and lower frame members and attached thereto.

25. The foldable seat and hot tub system of claim 24 wherein at least one of said front and back frames supports a seat, and said front and back frames each include left and right side frame members having lengths, said lengths being adjustable to accommodate desired heights and inclinations of said seat.

26. The foldable seat and hot tub system of claim 25 wherein said lengths of said left and right side frame members are adjustable by removal of a length portion of said left and right side frame members.

27. The foldable seat and hot tub system of claim 24 wherein said first end of said first cross-member is rotatably connected to said upper frame member of said front frame, said second end of said first cross-member is rotatably connected to said upper frame member of said back frame, said first end of said second cross-member is rotatably connected to said lower frame member of said front frame, and said second end of said second cross-member is rotatably connected to said lower frame member of said back frame.

28. The foldable seat and hot tub system of claim 24 wherein said back frame includes a rearward projecting attachment member, said attachment member having a forward end attached to one of said left and right side frame members of said back frame and a rearward end adapted for secure attachment to said sidewall of said hot tub.

29. The foldable seat and hot tub system of claim 28 wherein the one of said left and right side frame members to which said forward end of said attachment member is attached has a tubular portion, and said forward end of said attachment member has a coupler portion with a transverse aperture sized to rotatably receive said tubular portion.

30. The foldable seat and hot tub system of claim 24 wherein said back frame includes a rearward projecting, left side attachment member having a forward end rotatably connected to said left side frame member of said back frame and a rearward end adapted for secure attachment to the sidewall of the hot tub, and a rearward projecting, right side attachment member having a forward end rotatably connected to said right side frame member of said back frame and a rearward end adapted for secure attachment to the sidewall of the hot tub.

31. The foldable seat and hot tub system of claim 18 wherein said back frame includes a rearward projecting attachment portion having an end securely attachable to said sidewall of said hot tub.

32. A foldable seat for use in a hot tub having a sidewall, comprising:

a front frame, said front frame having an upper frame tube with first and second ends, a lower frame tube with first and second ends spaced below said upper frame tube, a left frame tube with first and second ends, said first end of said left frame tube being connected by a first corner connector to said first end of said upper frame tube and said second end of said left frame tube being connected by a second corner connector to said first end of said lower frame tube, a right frame tube with first and second ends, said first end of said right frame tube being connected by a third corner connector to said second end of said upper frame tube and said second end of said right frame tube being connected by a fourth corner connector to said second end of said lower frame tube;

a back frame, said back frame having an upper frame tube with first and second ends, a lower frame tube with first and second ends spaced below said upper frame tube, a left frame tube with first and second ends, said first end of said left frame tube being connected by a fifth corner connector to said first end of said upper frame tube and said second end of said left frame tube being connected by a sixth corner connector to said first end of said lower frame tube, a right frame tube with first and second ends, said first end of said right frame tube being connected by a seventh corner connector to said second end of said upper frame tube and said second end of said right frame tube being connected by an eighth corner connector to said second end of said lower frame tube;

two upper first cross tubes extending between and rotatably coupled to said upper frame tubes of said front and back frames, said first cross tubes each having first and second ends, said first and second ends each being connected to a "T" coupler, said "T" couplers each having a first leg connected to one of said first and second ends of one of said first cross tubes and having a transverse leg with an aperture formed therein to rotatably receive one of said upper frame tubes of said front and back frames said two upper first cross tubes being spaced apart;

a lower second cross tube extending between and rotatably coupled to said lower frame tubes of said front and back frames, said second cross tube having first and second ends, said first and second ends each being connected to a "T" coupler, said "T" couplers each having a first leg connected to one of said first and second ends of said second cross tube and having a transverse leg with an aperture formed therein to rotatably receive one of said lower frame tubes of said front and back frames;

left and right side attachment members, said attachment members each having first and second ends, said first ends each being connected to a "T" coupler, said "T" couplers each having a first leg connected to said first end of one of said attachment members and having a transverse leg with an aperture formed therein to rotatably receive one of said left and right side frame tubes of said back frame, said second ends of said attachment members being adapted for connection to the sidewall of the hot tub; and a seat portion supported by said upper first cross tubes.

* * * * *